US010113801B2

(12) United States Patent
Korth et al.

(10) Patent No.: US 10,113,801 B2
(45) Date of Patent: Oct. 30, 2018

(54) MULTI-FLUID HEAT EXCHANGER ARRANGEMENT

(75) Inventors: Jay S. Korth, Jackson, TN (US); Geoff Smith, Jackson, TN (US)

(73) Assignee: Wabtec Holding Corp., Wilmerding, PA (US)

( * ) Notice: Subject to any disclaimer, the term of this patent is extended or adjusted under 35 U.S.C. 154(b) by 1443 days.

(21) Appl. No.: 12/159,272

(22) PCT Filed: Dec. 28, 2006

(86) PCT No.: PCT/US2006/049422

§ 371 (c)(1),
(2), (4) Date: Sep. 25, 2008

(87) PCT Pub. No.: WO2007/079140

PCT Pub. Date: Jul. 12, 2007

(65) Prior Publication Data

US 2009/0038778 A1 Feb. 12, 2009

Related U.S. Application Data

(60) Provisional application No. 60/754,335, filed on Dec. 28, 2005.

(51) Int. Cl.
*F28D 1/00* (2006.01)
*F28D 1/04* (2006.01)
(Continued)

(52) U.S. Cl.
CPC ..... *F28D 1/0443* (2013.01); *F28F 9/001* (2013.01); *F28F 9/0209* (2013.01); *F28F 9/16* (2013.01); *F28F 9/18* (2013.01); *F28F 21/08* (2013.01)

(58) Field of Classification Search
USPC ..... 165/140, 916
See application file for complete search history.

(56) References Cited

U.S. PATENT DOCUMENTS 1,948,929 A 2/1934 MacPherson
2,037,845 A 4/1936 Young
(Continued)

FOREIGN PATENT DOCUMENTS

FR 2 785 376 A1 5/2000

*Primary Examiner* — Devon Russell
(74) *Attorney, Agent, or Firm* — The Webb Law Firm

(57) ABSTRACT

A multi-fluid heat exchanger assembly Is provided that integrates multiple and distinct heat exchanger systems into a single, integrated system or housing utilizing a common header. Any combination of techniques as described may be utilized for optimizing exchanger performance according to the particular fluids being cooled. The heat exchanger assembly can be optimized by utilizing a pair of opposed headers having a first set of openings and a tube core arranged according to a first configuration and a second set of openings and a tube core arranged according to a second configuration and wherein the first and second configurations are different from one another. The heat exchanger assembly can also be optimized through different tube core/fin joining techniques for each of the distinct heat exchanger systems. Another technique for optimizing the heat exchanger assembly is through the use of differing core depths for each of the distinct heat exchanger systems.

23 Claims, 7 Drawing Sheets

(51) Int. Cl.

| | |
|---|---|
| ***F28F 9/00*** | (2006.01) |
| ***F28F 9/02*** | (2006.01) |
| *F28F 9/16* | (2006.01) |
| *F28F 9/18* | (2006.01) |
| *F28F 21/08* | (2006.01) |

(56) References Cited

U.S. PATENT DOCUMENTS

| | | | | | |
|---|---|---|---|---|---|
| 2,264,820 | A | | 12/1941 | Young | |
| 2,505,790 | A | | 5/1950 | Panthofer | |
| 3,857,151 | A | * | 12/1974 | Young et al. | 29/890.047 |
| 4,137,982 | A | | 2/1979 | Crews et al. | |
| 4,559,688 | A | * | 12/1985 | Abu-Isa et al. | 29/890.052 |
| 4,651,816 | A | | 3/1987 | Struss et al. | |
| 4,688,311 | A | | 8/1987 | Saperstein et al. | |
| 4,715,910 | A | * | 12/1987 | Mandigo et al. | 148/414 |
| 4,923,001 | A | | 5/1990 | Marcolin | |
| 4,947,931 | A | | 8/1990 | Vitacco | |
| 5,009,262 | A | | 4/1991 | Halstead et al. | |
| 5,036,910 | A | | 8/1991 | Wolf | |
| 5,129,144 | A | | 7/1992 | Halstead et al. | |
| 5,186,244 | A | | 2/1993 | Joshi | |
| 5,186,246 | A | | 2/1993 | Halstead | |
| 5,366,005 | A | | 11/1994 | Kadle | |
| 5,378,294 | A | | 1/1995 | Rissanen | |
| 5,429,794 | A | * | 7/1995 | Kamf et al. | 420/477 |
| 5,720,341 | A | | 2/1998 | Watanabe et al. | |
| 5,881,456 | A | | 3/1999 | Bergins et al. | |
| 6,035,927 | A | * | 3/2000 | Krauss et al. | 165/135 |
| 6,173,766 | B1 | | 1/2001 | Nakamura et al. | |
| 6,264,764 | B1 | | 7/2001 | Kamf et al. | |
| 6,321,832 | B1 | | 11/2001 | Le | |
| 6,394,176 | B1 | | 5/2002 | Marsais | |
| 6,883,600 | B2 | * | 4/2005 | Mano et al. | 165/174 |
| 6,997,371 | B2 | | 2/2006 | Shabtay | |
| 7,032,808 | B2 | | 4/2006 | Shabtay | |
| 7,036,570 | B2 | | 5/2006 | Korth et al. | |
| 7,096,932 | B2 | | 8/2006 | Scoville et al. | |
| 7,143,822 | B2 | * | 12/2006 | Wisniewski | 165/140 |
| 7,779,893 | B2 | * | 8/2010 | Leitch et al. | 165/70 |
| 2002/0040766 | A1 | | 4/2002 | Takahashi et al. | |
| 2002/0040776 | A1 | | 4/2002 | Kokubunji et al. | |
| 2003/0230567 | A1 | * | 12/2003 | Centanni et al. | 219/628 |
| 2004/0040698 | A1 | * | 3/2004 | Korth et al. | 165/173 |
| 2005/0006070 | A1 | * | 1/2005 | Kamiyama et al. | 165/140 |
| 2005/0257921 | A1 | * | 11/2005 | Hu | 165/140 |
| 2005/0283967 | A1 | | 12/2005 | Panthofer | |
| 2006/0249559 | A1 | | 11/2006 | Panthofer | |
| 2011/0075370 | A1 | * | 3/2011 | Abe | H01L 23/427 361/700 |

* cited by examiner 18
20,22,24
22
24
26
28
30
34
36
38
39
40
46
48
50

MULTI-FLUID HEAT EXCHANGER ARRANGEMENT

BACKGROUND OF THE INVENTION

Field of the Invention

The present invention relates generally to heat exchangers and heat transfer equipment, and in particular, to a heat exchanger arrangement that includes separately manufactured multiple fluid transfer components housed in a common unit with a common and integral header portion.

Description of the Related Art

In the field of vehicle construction, multiple heat exchangers are used to cool multiple and different fluid streams and flows. Each of these heat exchangers is customized with respect to joining techniques of the exchanger components and the arrangement of the tubes within the tube core in order to optimize the functioning of the exchanger according to the parameters needed for a particular type of cooling system. According to the prior art, distinct and separate heat exchanger units are used to accomplish the cooling requirements. Further, these separate and distinct units are connected through some physical attachment to each other, or to the vehicle frame. For example, in a transit bus application, a radiator, oil cooler and charge air cooler may be attached in a stacked and side-by-side arrangement. Such an arrangement allows the air stream, which is pulled by a fan, to contact each heat exchanger separately.

These multiple-unit (heat exchanger) systems allow for the units to be attached in a variety of manners. For example, the units can be stacked and attached by a welding process, a bolting arrangement, a brazing process or some other well-known attachment method. Still further, each unit includes a distinct tank and a distinct header.

U.S. Pat. No. 7,096,932 to Scoville et al. shows a multi-fluid heat exchanger having separate fluid flow paths for two separate fluid streams to be heated or cooled by a third fluid stream. Scoville et al. teach a heat exchanger comprising a pair of headers, a plurality of flattened tubes forming two groups of tubes extending between the headers, a pair of baffles in each header between the groups of tubes so as to maintain an atmospheric pressure between the groups of tubes and prevent a build up of gas pressure during brazing. Scoville et al teach that the heat exchanger is assembled and then placed within a brazing oven whereat the brazing compound at the various interfaces flow to bond and seal the interfaces of the various components.

U.S. Pat. No. 6,394,176 to Marsais also teaches a multi-fluid heat exchanger for cooling separate fluid streams comprising a pair of manifolds, a plurality of tubes extending between the manifolds forming two separate banks of tubes, and insulating partitions between the banks of tubes for insulating the two fluids from one another. Marsais stresses the need for standardization of tube size and manifold holes for ease of manufacture.

Other patents and publications that teach multi-fluid heat exchangers include U.S. Pat. Nos. 1,948,929; 2,037,845; 2,264,820; 2,505,790; 4,137,982; 4,651,816; 4,688,311; 4,923,001; 4,947,931; 5,009,262; 5,036,910; 5,129,144; 5,186,244; 5,186,246; 5,366,005; 5,720,341; 5,881,456; 6,035,927; 6,173,766; and 6,321,832 and U.S. Patent Application Publication 2002/0040776.

SUMMARY OF THE INVENTION

It is, therefore, an object of the present invention to provide a multi-fluid heat exchanger arrangement that overcomes the drawbacks and deficiencies of the prior art. It is another object of the present invention to provide a multi-fluid heat exchanger arrangement that integrates multiple heat exchanger systems into a single, integrated system or housing utilizing a common header. It is a further object of the present invention to provide a multi-fluid heat exchanger arrangement that integrates multiple heat exchanger systems having different tube bank core arrangements/sizes/joining techniques as needed for optimizing the exchanger performance according to the particular fluids being cooled.

Accordingly, the present invention is directed to a heat exchanger arrangement that integrates multiple and distinct systems into a single system having a single, common header. According to a first embodiment, the invention comprises a pair of opposed headers, each of the headers includes a first set of openings and a second set of openings designed according to a first predetermined configuration and a second predetermined configuration. A first tube core comprising a first set of tubes is arranged according to the first predetermined configuration of the first set of openings. The first set of tubes has opposed ends aligned and secured within the first set of openings in the pair of opposed headers. A second tube core comprising a second set of tubes is arranged according to the second predetermined configuration of the second set of openings. The second set of tubes has opposed ends aligned and secured within the second set of openings in the pair of opposed headers. A core divider is positioned between the first tube core and the second tube core. The heat exchanger is optimized according to the particular fluids being cooled by having a different arrangement for the first predetermined configuration of the first set of openings and the first tube core from the second predetermined configuration of the second set of openings and the second tube core.

According to a second embodiment, the invention comprises a multi-fluid heat exchanger joined by a common header portion wherein the heat exchanger comprises a pair of opposed headers, each of the headers including a first set of openings and a second set of openings designed according to a first predetermined configuration and a second predetermined configuration. A first tube core comprises a first set of tubes arranged according to the first predetermined configuration of the first set of openings. The first set of tubes has their opposed ends aligned and secured within the first set of openings in the pair of opposed headers. A first fin core arrangement is provided wherein the fin core comprises a first series of fins extending between and in heat transfer relation with the first set of tubes. A second tube core comprises a second set of tubes arranged according to the second predetermined configuration of the second set of openings. The second set of tubes has their opposed ends aligned and secured within the second set of openings in the pair of opposed headers. A second fin core arrangement is provided wherein the fin core comprises a second series of fins extending between and in heat transfer relation with the second set of tubes. A core divider is positioned between the first tube core and the second tube core. The heat exchanger is optimized according to the particular fluids being cooled by using a different securing technique for securing the first set of tubes to the first series of fins of the first fin core arrangement than that used for securing the second set of tubes to the second series of fins of the second core arrangement.

According to a third embodiment, the invention comprises a multi-fluid heat exchanger joined by a common header portion wherein the heat exchanger comprises a pair. of opposed headers, each of the headers including a first set of openings designed according to a first predetermined configuration and a second set of openings designed according to a second predetermined configuration. A first tube core has a first set of tubes having a predetermined number of tubes according to a first predetermined core depth. The first set of tubes is arranged according to the first predetermined configuration of the first set of openings such that the opposed ends of the tubes are aligned and secured within the first set of openings in the pair of opposed headers. A second tube core comprises a second set of tubes having a predetermined number of tubes according to a second predetermined core depth. The second set of tubes is arranged according to the second predetermined configuration of the second set of openings such that the opposed ends of the tubes are aligned and secured within the second set of openings in the pair of opposed headers. A core divider is positioned between the first tube core and the second tube core. The heat exchanger is optimized according to the particular fluids being cooled by using a first predetermined depth of the first tube core which is different than the second predetermined depth of the second set tube core.

Three different embodiments are discussed above; however, different combinations of each of these embodiments can be utilized in the optimization of a multi-fluid heat exchanger. For example, a multi-fluid heat exchanger can be designed wherein varying core depths, securing techniques and tube arrangement may be utilized in a single multi-fluid heat exchanger assembly to optimize the heat exchanger according to the particular fluids being cooled. Also, it is noted that more than two core assemblies (i.e., three, four, etc.) may be joined in a side-by-side arrangement by a common header, depending upon the particular use of the heat exchanger assembly.

These and other features and characteristics of the present invention, as well as the methods of operation and functions of the related elements of structures and the combination of parts and economies of manufacture, will become more apparent upon consideration of the following description with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification, the singular form of "a", "an", and "the" include plural referents unless the context clearly dictates otherwise.

BRIEF DESCRIPTION OF THE DRAWINGS

FIG. 3(*d*) is an enlarged view of the interface portion between a first and second core member in a core arrangement according to the principles of the present invention;

DETAILED DESCRIPTION OF THE INVENTION

Figure 1B:
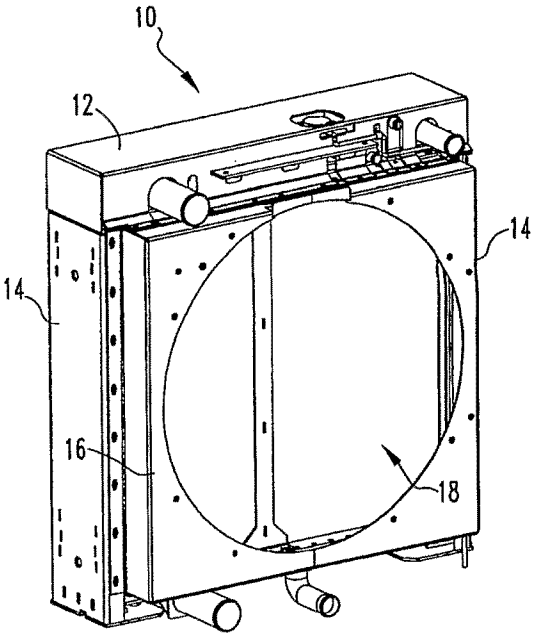
FIGS. 1(*a*)-1(*b*) show isometric views of two different types of multi-fluid heat exchanger assemblies according to the principles of the present invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

The present invention is directed to a multi-fluid heat exchanger arrangement that integrates multiple heat exchanger units or circuits, such as units that cool or otherwise remove heat from a fluid source. In addition, the present invention integrates these distinct and separate circuits, units or cores into a single housing where these units are in fluid communication with a single, common header.

Any type of header can be used in connection with the presently-invented arrangement. For example, the header could be soldered, brazed, welded or mechanically bonded to the tubes of the circuits. Any such attachment or joining methodology is envisioned for fixing the tubes of each unit to the common header.

In one embodiment, the heat exchanger circuits include "tube and fin" portions, which may be separate and distinct from each other. If separate "tube and fin" portions are being utilized, the arrangement of the present invention may also use a core divider to provide additional structural support to the arrangement at this joint.

It is envisioned that this invention can be used in connection with a variety of different types, styles and models of heat exchanger units, circuits or cores. In addition, each individual circuit, unit or core could use separate tanks for different fluids. However, in this invention, these separate units are in fluid communication with a single, common header portion and positioned within a common housing. It is further envisioned that a single, common header portion could be used in connection with a multi-functional core block.

Figure 1A:
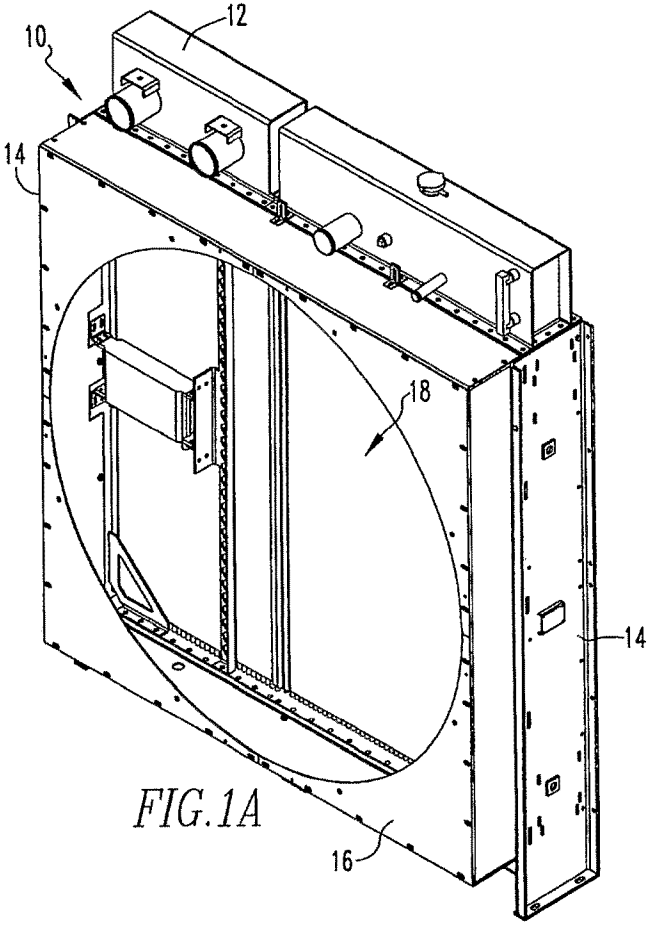

With reference to the drawings, FIGS. 1(*a*)-1(*b*) illustrate two preferred and non-limiting embodiments of a multi-fluid heat exchanger assembly, generally indicated as 10, according to the present invention wherein the heat exchanger is shown in an assembled form, including tanks 12, sides 14, fan shroud 16, and other components assembled to the core, generally indicated as 18, and header (not shown).

Figure 2B:
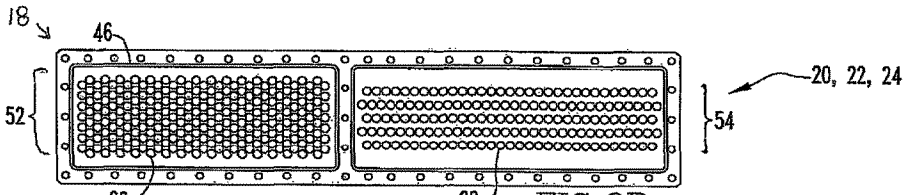
FIGS. 2(*a*)-2(*c*) are front, top/bottom and side views of the core assembly/header arrangement according to an embodiment which may be used in the multi-fluid heat exchanger assemblies of FIGS. 1(*a*)-1(*b*)
Figure 2A:
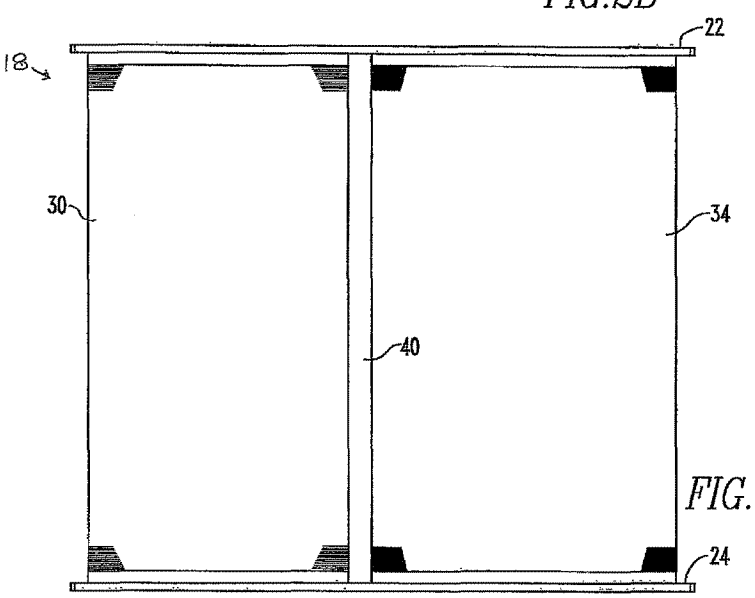
Figure 2C:
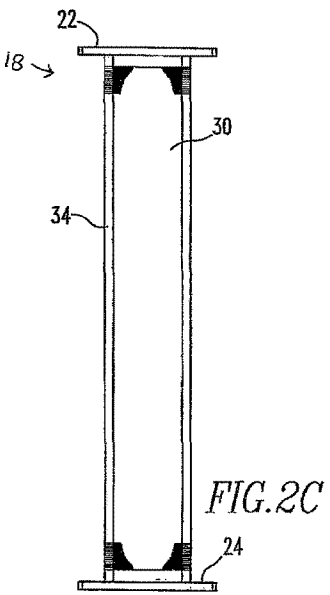
Figures 3A, 3B, 3C, 3D:
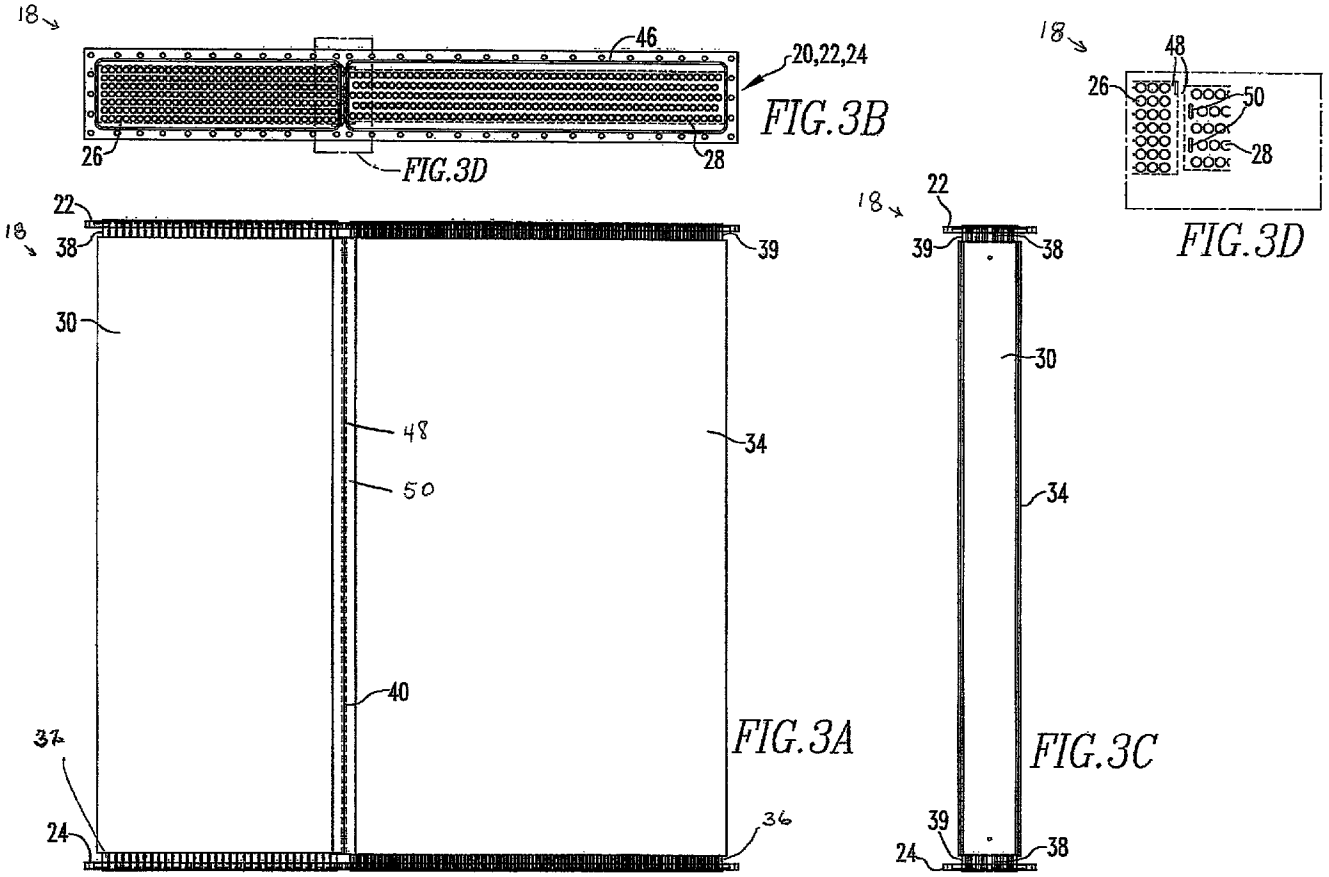
FIGS. 3(*a*)-3(*c*) are front, top/bottom and side views, respectively, of the core assembly/header arrangement according to another embodiment which may be used in the multi-fluid heat exchanger assemblies of FIGS. 1(*a*)-1(*b*)
Figure 4A:
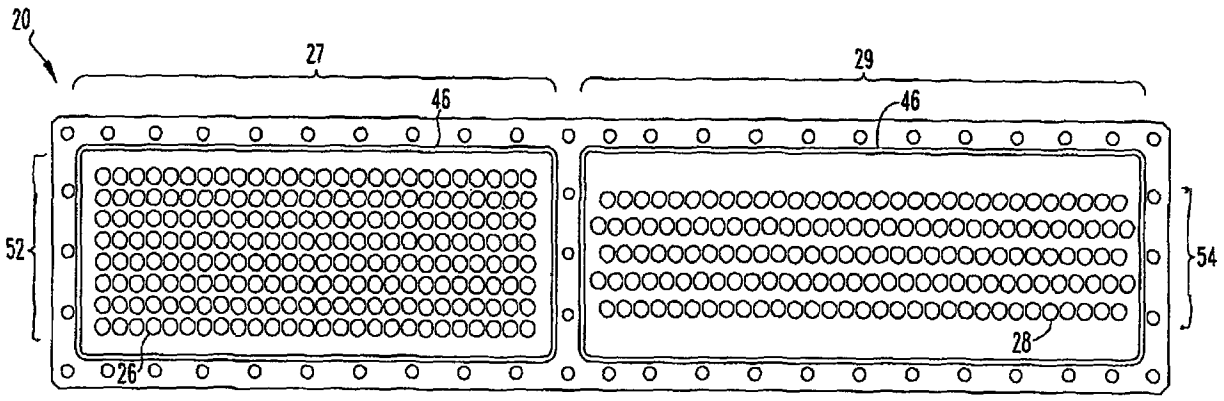
FIGS. 4(*a*)-4(*b*) are top and side views, respectively, of a header/hole configuration according to an embodiment of the multi-fluid hear exchanger assembly according to the principles of the present invention.
Figure 4B:
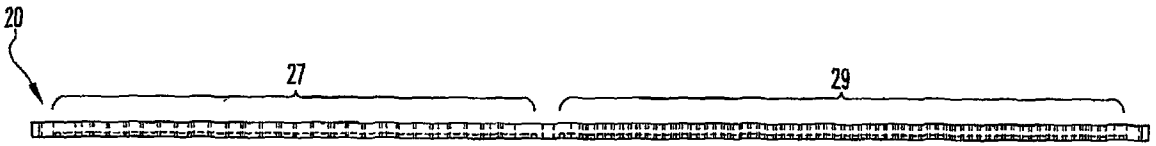
Figure 5A:
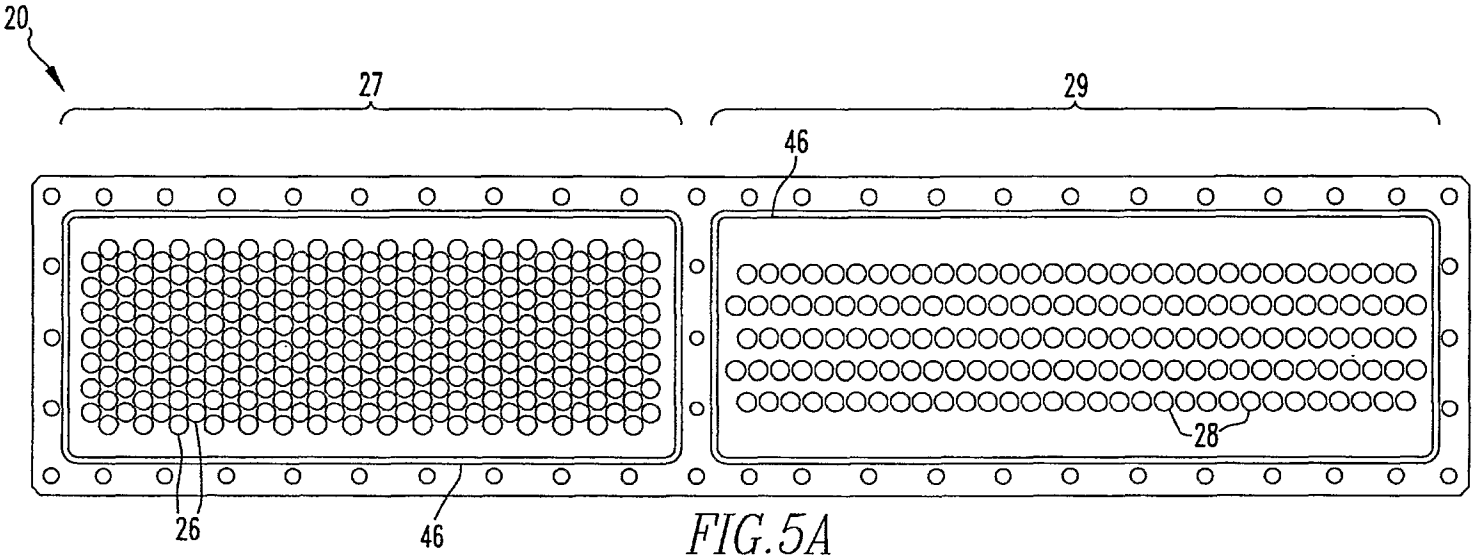
FIGS. 5(*a*)-5(*b*) are top and side views, respectively, of a header/hole configuration according to another embodiment of the multi-fluid heat exchanger assembly according to the principles of the present invention.
Figure 5B:
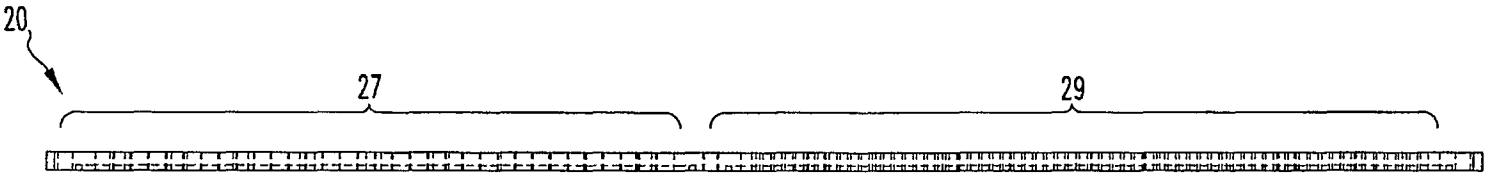

Reference is now made to FIGS. 2(*a*)-2(*c*) and FIGS. 3(*a*)-3(*c*) which illustrate front, top/bottom and side views, respectively, of the core assembly/header arrangement, generally indicated as 18, according to two different embodiments of the invention which can be used in the multi-fluid heat exchanger assembly. Reference is further made to FIGS. 4(*a*)-4(*b*) and FIGS. 5(*a*)-5(*b*) which illustrate top and side views, respectively, of a header, generally indicated as 20, according to two different embodiments of the invention which can be used in the multi-fluid heat exchanger assembly. The multi-fluid heat exchanger assembly joined by a common header portion of the invention, according to a first embodiment, comprises a pair of opposed headers 22, 24, each of the headers 22, 24 including a first set of openings 26 and a second set of openings 28 designed according to a first predetermined configuration 27 and a second predetermined configuration 29. The invention further comprises a first tube core 30 comprising a first set of tubes 32 arranged according to the first predetermined configuration 27 of the first set of openings 26. The first set of tubes 32 has opposed ends 38 aligned and secured within the first set of openings 26 in the pair of opposed headers 22, 24. A second tube core 34 is provided comprising a second set of tubes 36 arranged according to the second predetermined configuration 29 of the second set of openings 28. The second set of tubes 36 has opposed ends 39 aligned and secured within the second set of openings 28 in the pair of opposed headers 22, 24. A core divider 40 is positioned between the first tube core 30 and the second tube core 34.

According to a first embodiment, the multi-fluid heat exchanger 10 can be optimized according to the types of fluids being cooled by customizing the tube configuration as needed. For example, the first predetermined configuration 27 of the first set of openings 26 and the first tube core 30 has a different arrangement, such as a staggered array configuration as shown in FIG. 2(*b*), from the second predetermined configuration 29 of the second set of openings 28 of the second tube core 34, such as an end-to-end touching array as shown in FIGS. 2(*b*), 3(*b*), and 4(*a*). Also, as shown in FIG. 4(*a*), the spacing between the first set of openings 26 in the header 20 and first set of tubes 32 and the second set of openings 28 in the header 20 and the second set of tubes 36 may be varied as needed to optimize the performance of the heat exchanger.

The staggered arrangement shown in FIG. 2(*b*) is the subject of U.S. Pat. No. 7,003,879 to Smith et al. The description of this design is made with reference to the first set of tubes 32/header openings 26 shown in FIG. 2(*b*); however, any or all of the units or core tubes of the heat exchanger may have this staggered design. This design enables an increase in the airflow around the tubes 32 and increases a web in the header 20 around the tubes. In this design, the plurality of tubes 32 having an end configuration is arranged in a predetermined staggered array. The header 20 is provided with a predetermined number of openings 26 disposed in the predetermined staggered array corresponding to the arrangement of the plurality of tubes 32. The header 20 is formed by identifying a direction of airflow, determining at least one of a row pitch and a tube pitch of the predetermined number of openings, and aligning at least one of the row pitch and the tube pitch with respect to the airflow. The plurality of tubes 32 is arranged such that the row pitch and tube pitch are spaced substantially identical. A securing system is provided for securing an end of each of the plurality of tubes 32 within a corresponding opening 26 in the header 20. This securing system can be any process, e.g., mechanical, CUPROBRAZE™ (which utilizes a CuSnNiP system), solder and the like, as discussed in detail below.

A second embodiment for constructing one, two or any number of tube cores/units is disclosed in U.S. Pat. No. 7,036,570 to Korth et al. In this technique, an "end-to-end" or "tube touching" position of the tubes is used for the row spacing. This arrangement is illustrated in FIGS. 2(*b*), 3(*b*) and 4(*a*). In the description below, reference is made to the second set of header openings 28 and second set of tubes 36; however, any number of the tube units may be formed by this technique, such as shown in FIGS. 3(*b*) and 4(*a*) wherein both sets of tubes are constructed in this technique but wherein the spacing differs between the tube cores. In this technique, core structure of the heat exchanger comprises a plurality of tubes 36 having a predetermined end configuration, a header 20 having a number of openings 28 corresponding to the plurality of tubes such that the openings 28 are disposed in an end-to-end array and wherein the predetermined end configurations touch, and a securing system for securing an end of each of the plurality of tubes 36 into a corresponding one of the each of the openings 28 in the header 20. This securing system can be any process, e.g., mechanical, CUPROBRAZE™ (which utilizes a CuSnNiP system), solder and the like, as discussed in detail below.

Figure 6:
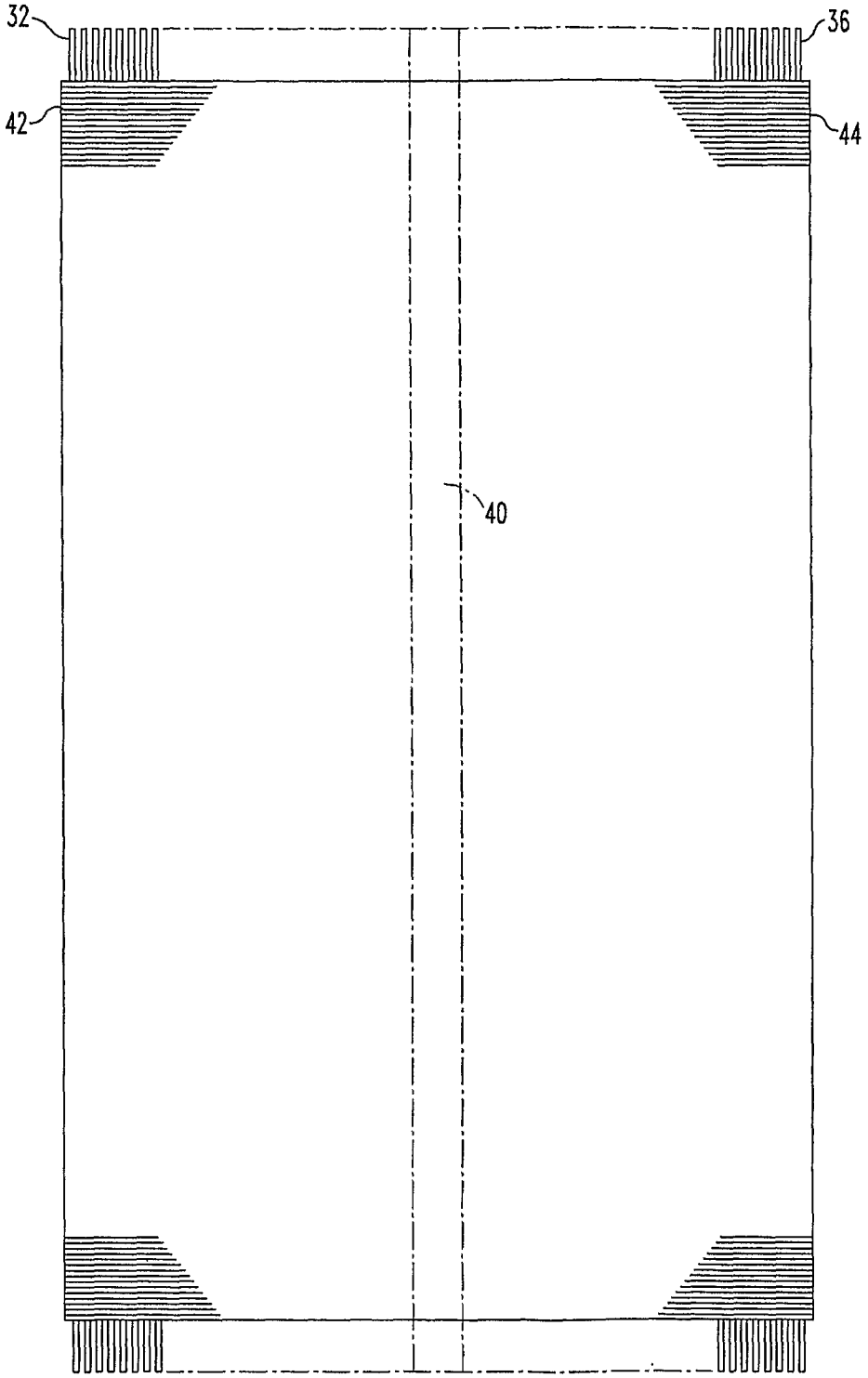
FIG. 6 is a front view of the fin/tube arrangement of the multi-fluid heat exchanger assembly according to the principles of the present invention.

As shown in FIG. 6, the first tube core 30 includes a first fin core arrangement comprising a first series of fins 42 extending between and in heat transfer relation with the first set of tubes 32. The second tube core 34 includes a second fin core arrangement comprising a second series of fins 44 extending between and in heat transfer relation with the second set of tubes 36.

According to a second embodiment of the invention, the multi-fluid heat exchanger can be optimized wherein the first set of tubes 32 is secured to the first series of fins 42 of the first fin core arrangement according to a first technique and the second set of tubes 36 is secured to the second series of fins 44 of the second core arrangement according to a second technique which is different from the first technique. These techniques are discussed in detail below. Note that either unit(s)/tube core(s) may be attached by any combination of these techniques in order to optimize the performance of the heat exchanger according to the particular fluid being cooled in the individual unit(s).

A first preferred technique for attaching these tubes to fins of the heat exchanger is by a mechanical attachment wherein the individual tubes are mechanically expanded or balled into the fins having similar hole geometry to provide the tube-to-fin connection. The ends of the tubes may also be mechanically attached to the header in this same manner. This expansion technique for constructing a heat exchanger is discussed in detail in U.S. Pat. No. 3,857,151 to Young et al.

A second preferred technique for attaching the tubes to the fins of the heat exchanger and for attaching the ends of the tubes to the header is a technique known as a CUPROBRAZE™ technique. CUPROBRAZE™ is a manufacturing process that is used to braze copper and brass at temperatures that are generally lower than normal brazing operations but do not exceed the softening temperatures of the components being joined. This process involves depositing a braze paste on the tubes or fins, which are then assembled and heated to a suitable brazing temperature. The paste used as the brazing compound is known as OKC 600, as discussed in U.S. Pat. No. 5,378,294 to Rissanen and U.S. Pat. Nos. 5,429,794 and 6,264,764 to Kamf et al. This compound contains binders and a metal braze alloy based on the CuSnNiP system, for example, about 75% copper, about 15% tin, about 5% nickel, and about 5% phosphorus. Other compounds and methods are being developed for use with the CUPROBRAZE™ technique. These compounds are the subject of U.S. Pat. Nos. 6,997,371 and 7,032,808 to Shabtay and U.S. Patent Application Publication Nos. 2005/0283967 and 2006/0249559 to Panthofer.

It is noted that the multi-fluid heat exchanger 10 of the present invention is not limited to the tube-to-fin and tube-to-header attachment techniques discussed above. Other types of attachment techniques may be utilized for attachment of the tubes to the fins and the headers such as welding, soldering, adhesive and the like.

During the construction of the multi-fluid heat exchanger 10 of the invention, it was determined that when utilizing the CUPROBRAZE™ process, it was necessary to add a small percentage of iron to the copper alloy tube to make it "anneal resistant". In the application of the CUPROBRAZE™ process as it pertains to this invention, it is necessary to anneal the tube to get it to properly form into the correct shape and to mechanically roll to the joint. It was found that the grain size of the material had to be increased at the tube end so that it did not "work harden" during transforming and prematurely fail due to cyclic fatigue in the end user application or during testing.

The multi-fluid heat exchanger 10 of the invention can include a fin core constructed according to any known structure including a serpentine, square wave, corrugated fin or oval tube arrangement. Any combination of these fin core structures can be utilized in the invention.

A third embodiment for the multi-fluid heat exchanger 10 joined by a common header portion 20 of the invention is particularly shown in FIGS. 2(*b*)-2(*c*) and 4(*a*). This embodiment comprises an exchanger wherein the first tube core 30 has a first set of tubes 32 having a predetermined number of tubes according to a first predetermined core depth 52. This first set of tubes 32 is arranged according to the first predetermined configuration 27 of the first set of openings 26 in the headers 22, 24 and the first predetermined core depth 52. The first set of tubes 32 has opposed ends which are aligned and secured within the first set of openings 26 in the pair of opposed headers 22, 24. The second tube core 34 comprises a second set of tubes 36 having a predetermined number of tubes according to a second predetermined core depth 54. This second set of tubes 36 is arranged according to the second predetermined configuration 29 of the second set of openings 28 and the second predetermined core depth 54. The second set of tubes 36 has opposed ends which are aligned and secured within the second set of openings 28 in the pair of opposed headers 22, 24. This embodiment allows for the optimization of the heat exchanger 10 by the provision of the first predetermined depth 52 of the first tube core 30 being different than the second predetermined depth 54 of the second tube core 34.

Figure 7A:
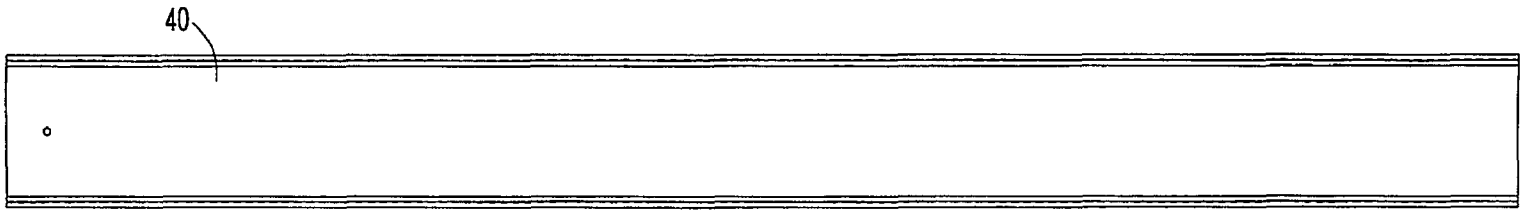
FIGS. 7(*a*)-7(*b*) are front and side views, respectively, of a core divider member according to an embodiment of the multi-fluid heat exchanger assembly according to the principles of the present invention.
Figure 7B:
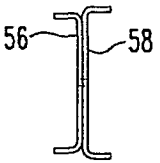

FIGS. 7(*a*)-7(*b*) show an example of the core divider 40 which may be used in the invention. This core divider 40 comprises a pair of opposed C-shaped channels 56, 58 which may be positioned between and adjacent the first tube core 30 and the second tube core 34. As shown in FIG. 7(*b*), C-shaped member 56 is smaller than C-shaped member 58, illustrating the core divider 40 which may be used with a heat exchanger having tube cores of varying depth. An alternative to the opposed C-shaped channels illustrated in FIGS. 7(*a*)-7(*b*) is the use of a rectangular piece of metal that slides through the space inbetween the cores instead of wrapping around the cores like the C-shaped channels.

The core divider 40 also includes a reinforcement member 48 positioned adjacent thereto. One example of the reinforcement member, generally illustrated as 48, for the heat exchanger 10 is shown in FIG. 3(*d*). In this example, a plurality of dead tubes 50 is shown positioned adjacent the core divider 40. Alternatively, a solid piece of material for reinforcement purposes may be inserted adjacent the core divider 40. The type of reinforcement member can be determined based upon a number of factors, including but not limited to, product performance specifications, required strength of the product, cost requirements, weight specifications and the like.

It is preferred that the multi-fluid heat exchanger 10 is designed such that the first tube core 30 and the second tube core 34 are arranged in a side-by-side arrangement.

Also, it is preferred that the header 22, positioned adjacent to the tank(s) 12 includes an O-ring 46, as shown in FIGS. 2(*b*), 3(*b*) and 4(*a*), surrounding the first set of openings 26 and the second set of openings 28. This O-ring provides a seal between the header 22 and tank(s) 12 for maintaining separation of the fluids flowing through the first tube core 30 and the second tube core 34. Although an O-ring is shown, any type of sealing gasket can be used which will maintain separation of the fluids.

The invention envisions any combination of the three embodiments discussed above to optimize the performance of the multi-fluid heat exchanger according to the particular performance requirements of the exchanger. The multi-fluid heat exchanger can be designed wherein a first core has one or more of a varying tube configuration, tube-to-fin and/or tube-to-header joining technique, and differing depth than a second tube core. Additionally, the invention is not limited just to a two unit side-by-side configuration. The present invention encompasses any number of units (i.e., three, four and the like) joined together by a common header.

The present invention provides many benefits. First, the use of the common, single header portion will reduce the overall package size, weight and cost, as the arrangement includes a common header, as opposed to two, three or even additional header portions. Second, the presently-invented arrangement evidences a reduced installation time, since forming only a single, common header requires only installation and setup for that single header.

Assembly of the arrangement is quicker with only a single, common header. The size of this single, common header could be reduced as the total stack-up should become less, as a mating surface is not required between the components. Third, the overall arrangement weight is reduced as the structural mating surfaces between components or units are eliminated and replaced by a lighter core divider.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A multi-fluid heat exchanger joined by a common header portion, said heat exchanger comprising:

(a) a pair of opposed headers, each of said headers comprising a single plate and including a first set of openings and a second set of openings designed according to a first predetermined configuration and a second predetermined configuration, wherein the first set of openings and the second set of openings are positioned adjacent one another on the single plate of each of the pair of opposed headers;

(b) a first tube core comprising a first set of tubes arranged according to said first predetermined configuration of said first set of openings, said first set of tubes having opposed ends aligned and secured within said first set of openings in said pair of opposed headers, wherein the first predetermined configuration of the first tube core comprises an array having a first predetermined spacing between the tubes;

(c) a second tube core comprising a second set of tubes arranged according to said second predetermined configuration of said second set of openings, said second set of tubes having opposed ends aligned and secured within said second set of openings in said pair of opposed headers, wherein the second predetermined configuration of the second tube core comprises an array having a second predetermined spacing between the tubes; and (d) a core divider positioned between said first tube core and said second tube core, said core divider including a reinforcement member positioned adjacent thereto, wherein the core divider and the reinforcement member extend substantially the entire length of the first and second tube cores, wherein said first predetermined configuration of said first set of openings and said first tube core has a different arrangement from said second predetermined configuration of said second set of openings and said second tube core and wherein the first predetermined spacing is different than the second predetermined spacing.

2. The multi-fluid heat exchanger as recited in claim 1 wherein said opposed ends of at least one of said first and second set of tubes are mechanically expanded into at least one of said first and second set of holes within the header to provide a tube-to-header connection.

3. The multi-fluid heat exchanger as recited in claim 1 wherein said opposed ends of at least one of said first and second set of tubes are joined to at least one of said first and second set of holes within the header utilizing a brazing process comprising a metal braze alloy based on a CuSnNiP system.

4. The multi-fluid heat exchanger as recited in claim 3 wherein at least one of said first and second set of tubes is comprised of a brass alloy containing a small percentage of iron to cause said tubes to become anneal resistant.

5. The multi-fluid heat exchanger as recited in claim 1 wherein said opposed ends of at least one of said first and second set of tubes are joined to at least one of said first and second set of holes within the header utilizing one of a soldering and brazing process.

6. The multi-fluid heat exchanger as recited in claim 1 wherein said first predetermined configuration of said first set of openings and said first set of tubes comprises a staggered array.

7. The multi-fluid heat exchanger as recited in claim 1 wherein said second predetermined configuration of said second set of openings and said second set of tubes comprises an end-to-end touching array.

8. The multi-fluid heat exchanger as recited in claim 1 wherein said first tube core and said second tube core are provided in a side-by-side arrangement.

9. The multi-fluid heat exchanger as recited in claim 1 wherein one of said pair of opposed headers includes an O-ring thereon surrounding said first set of openings and said second set of openings, said O-ring providing a seal between the header and tank for maintaining separation of the fluids flowing through said first tube core and said second tube core.

10. The multi-fluid heat exchanger as recited in claim 1 wherein said first tube core includes a first series of fins secured to said first set of tubes by a first technique, wherein said second tube core includes a second series of fins secured to said second set of tubes by a second technique, and wherein said first and second securing techniques are different from one another.

11. The multi-fluid heat exchanger as recited in claim 10 wherein said first and second securing techniques comprise one of a mechanical joining, a brazing process, a CuSnNiP brazing process and a soldering process.

12. The multi-fluid heat exchanger as recited in claim 1 wherein said first set of tubes comprises a plurality of rows of tubes arranged according to a first predetermined core depth, wherein said second set of tubes comprises a plurality of rows of tubes arranged according to a second predetermined core depth, and wherein said first and second predetermined core depths are different from one another.

13. The multi-fluid heat exchanger as recited in claim 10 wherein said first set of tubes is arranged according to a first predetermined core depth, wherein said second set of tubes are arranged according to a second predetermined core depth, and wherein said first and second predetermined core depths are different from one another.

14. The multi-fluid heat exchanger as recited in claim 1, wherein the reinforcement member comprises a plurality of dead tubes positioned adjacent the core divider.

15. A multi-fluid heat exchanger joined by a common header portion, said heat exchanger comprising;

(a) a pair of opposed headers, each of said headers comprising a single plate and including a first set of openings and a second set of openings designed according to a first predetermined configuration and a second predetermined configuration, wherein the first set of openings and the second set of openings are positioned adjacent one another on the single plate of each of the pair of opposed headers;

(b) a first tube core comprising a first set of tubes arranged according to said first predetermined configuration of said first set of openings, said first set of tubes having opposed ends aligned and secured within said first set of openings in said pair of opposed headers;

(c) a first fin core arrangement comprising a first series of fins extending between and in heat transfer relation with said first set of tubes;

(d) a second tube core comprising a second set of tubes arranged according to said second predetermined configuration of said second set of openings, said second set of tubes having opposed ends aligned and secured within said second set of openings in said pair of opposed headers;

(e) a second fin core arrangement comprising a second series of fins extending between and in heat transfer relation with said second set of tubes; and (f) a core divider positioned between said first tube core and said second tube core, said core divider including a reinforcement member positioned adjacent thereto, wherein the core divider and the reinforcement member extend substantially the entire length of the first and second tube cores, wherein said first set of tubes is secured to the first series of fins of said first fin core arrangement according to a first technique and said second set of tubes is secured to the second series of fins of said second core arrangement according to a second technique which is different from said first technique;

wherein said opposed ends of at least one of said first and second set of tubes are joined to at least one of said first and second set of holes within the header utilizing a brazing process comprising a metal braze alloy based on a CuSnNiP system;

wherein at least one of said first and second set of tubes is comprised of a brass alloy containing a small percentage of iron to cause said tubes to become anneal resistant.

16. A multi-fluid heat exchanger joined by a common header portion, said heat exchanger comprising:

(a) a pair of opposed headers, each of said headers comprising a single plate and including a first set of openings designed according to a first predetermined configuration and a second set of openings designed according to a second predetermined configuration, wherein the first set of openings and the second set of openings are positioned adjacent one another on the single plate of each of the pair of opposed headers;

(b) a first tube core having a first set of tubes having a plurality of rows of tubes arranged according to a first predetermined core depth, said first set of tubes arranged according to said first predetermined configuration of said first set of openings and said first predetermined core depth, said first set of tubes having opposed ends aligned and secured within said first set of openings in said pair of opposed headers;

(c) a second tube core comprising a second set of tubes having a plurality of rows of tubes arranged according to a second predetermined core depth, said second set of tubes arranged according to said second predetermined configuration of said second set of openings and said second predetermined core depth, said second set of tubes having opposed ends aligned and secured within said second set of openings in said pair of opposed headers; and (d) a core divider positioned between said first tube core and said second tube core, said core divider including a reinforcement member positioned adjacent thereto and extending along a longitudinal length of the core divider, wherein the first predetermined depth and the second predetermined depth is defined as the length of airflow through the first tube core and the second tube core, and wherein said first predetermined depth of said first tube core is different than said second predetermined depth of said second set tube core.

17. The multi-fluid heat exchanger as recited in claim 16 wherein said opposed ends of at least one of said first and second set of tubes are mechanically expanded into at least one of said first and second set of holes within the header to provide a tube-to-header connection.

18. The multi-fluid heat exchanger as recited in claim 16 wherein said opposed ends of at least one of said first and second set of tubes are joined to at least one of said first and second set of holes within the header utilizing a brazing process comprising a metal braze alloy based on a CuSnNiP system.

19. The multi-fluid heat exchanger as recited in claim 18 wherein at least one of said first and second set of tubes is comprised of a brass alloy containing a small percentage of iron to cause said tubes to become anneal resistant.

20. The multi-fluid heat exchanger as recited in claim 16 wherein said opposed ends of at least one of said first and second set of tubes are joined to at least one of said first and second set of holes within the header utilizing one of a soldering and brazing process.

21. The multi-fluid heat exchanger as recited in claim 16 wherein said first tube core and said second tube core are provided in a side-by-side arrangement.

22. The multi-fluid heat exchanger as recited in claim 16 wherein one of said pair of opposed headers includes an O-ring thereon surrounding said first set of openings and said second set of openings, said O-ring providing a seal between the header and tank for maintaining separation of the fluids flowing through said first tube core and said second tube core.

23. The multi-fluid heat exchanger as recited in claim 16, wherein the reinforcement member comprises a plurality of dead tubes positioned adjacent the core divider.

* * * * *